United States Patent [19]

Wrulich et al.

[11] 4,159,746

[45] Jul. 3, 1979

[54] BIT OF CIRCULAR CROSS-SECTION

[75] Inventors: Herwig Wrulich, Zeltweg; Karlheinz Gehring, Trofaiach; Alfred Zitz, Zeltweg, all of Austria

[73] Assignee: Vereinigte Osterreichische Eisen- und Stahlwerke-Alpine Montan Aktiengesellschaft, Vienna, Austria

[21] Appl. No.: 787,221

[22] Filed: Apr. 13, 1977

[30] Foreign Application Priority Data

Apr. 14, 1976 [AT] Austria ..... 2750/76

[51] Int. Cl.[2] ..... E21B 9/08

[52] U.S. Cl. ..... 175/354; 175/410; 299/86

[58] Field of Search ..... 175/354, 374, 410; 299/86

[56] References Cited

U.S. PATENT DOCUMENTS

| | | | |
|---|---|---|---|
| 3,258,077 | 6/1966 | Phipps | 175/410 X |
| 3,493,268 | 2/1970 | Bower, Jr. | 299/86 |
| 3,603,414 | 1/1972 | Stebley | 175/374 |
| 3,650,565 | 3/1972 | Kniff | 299/86 |
| 3,870,370 | 3/1975 | Winberg | 299/86 |
| 3,957,307 | 5/1976 | Varda | 299/86 |

*Primary Examiner*—Ernest R. Purser
*Assistant Examiner*—Richard E. Favreau
*Attorney, Agent, or Firm*—Cushman, Darby & Cushman

[57] ABSTRACT

A cutting bit includes a bit tip and a shaft having a portion tapered toward the tip and having a reduced diameter between the tapered portion and the portion intended to be inserted in a holder. The bit tip has the shape of a body of revolution with convex generatrices.

7 Claims, 3 Drawing Figures

BIT OF CIRCULAR CROSS-SECTION

The present invention refers to a bit of circular cross-section and having a bit shaft tapering in direction to the bit tip according to a body of revolution and being adapted for being inserted with its shaft portion opposed to the bit tip into a bit holder, preferably a bit of the type in which a bit tip consisting of carbide metal is inserted into the bit shaft. Such bits of circular cross-section are suitable for cutting rock as for instance in tunnel construction and coal mining and are, for example, used in cutting heads of cutting machines. Known bits of the type mentioned have a conical tip which passes over into a cylindrical shaft having a diameter equal to the greatest diameter of the conical tip.

The invention now aims at increasing the cutting efficiency of such bits of circular cross-section and essentially consists in that the bit tip has the shape of a body of revolution and in that the bit shaft is reduced to a smaller diameter between that area at which the taper of the bit in direction to its tip begins and the shaft portion to be inserted into the bit holder.

By giving the bit tip a camber with convex generatrices the bit tip is given an increased stability and is less subjected to rupture. After having forced the bit tip into the material to be cut or the mine face, respectively, the bit shaft must be moved with the total of its cross-section through the material to be cut. In this case known bits comprising a conical tip and having a cylindrical shaft directly joining the cone of the bit tip, require a high power, particularly with hard and tough material to be cut. By giving the bit tip a camber, the bit tip removes material over a greater cross-section, so that the resistance to be overcome by the bit shaft is being reduced. Furthermore it has proven that a bit tip according to the invention results in a better cutting efficiency than can be obtained with a conical bit tip, so that, with a given energy consumption the chip width can be increased and, respectively, with equal chip width the energy consumption can be reduced. By giving the bit shaft a smaller diameter between bit tip and bit holder, the resistance to be overcome by the bit shaft within the material to be cut is being reduced. Each of both features provide the possibility to reduce the power requirements for a given cutting work. By combining both features an optimum can be obtained. While in known bits of circular cross-section and comprising conical tips the point angle was within the range of 75° to 80°, the shape of a bit according to the invention is preferably such that the convex generatrices include an angle of at least 100°, preferably about 110°, at the bit tip.

In an embodiment in which the bit tip consisting of carbide metal is inserted into the bit shaft, it is preferred, according to the invention, that only the bit tip consisting of carbide metal has convex generatrices, while the bit shaft is tapering in direction to the bit tip as a truncated cone and has straight generatrices. This provides the advantage that most of the cutting work is done by the carbide metal tip whereas the portion, having the shape of a truncated cone, of the bit shaft, which has a smaller hardness, is being spared. In this case, it is of advantage if, according to the invention, the tip angle of the generatrices of the bit tip is, at the area of transition to the bit shaft, approximately equal to the taper of the truncated conical portion of the bit shaft, so that the carbide metal tip is essentially passing smoothly into the tapered portion of the bit shaft, According to the invention, the bit shaft preferably has a cylindrical portion between the starting end of the taper and the portion reduced to a smaller diameter. Thus, a sharp edge between the tapering portion of the bit shaft and the portion of reduced diameter can be avoided. The conically tapering portion of the bit shaft must comprise a bore for inserting the carbide metal tip. The cylindrical portion located between the starting end of the taper and the portion reduced to a smaller diameter provides for a sufficient cross-section of the shaft at the bottom of said bore. In an embodiment of the bit shaft, in which the bit shaft has a collar covering the bore of the bit holder, the portion reduced to a smaller diameter is extending, according to the invention, up to the collar.

According to a preferred embodiment of the invention, the diameter of the portion reduced to a smaller diameter is smaller for 15% up to 25%, preferably for approximately 20%, than the diameter of the bit shaft at the starting end of the taper. Such an amount of reduction in diameter has proved as effective.

The invention is schematically illustrated with reference to the drawing showing an embodiment of the invention.

Figure 1:
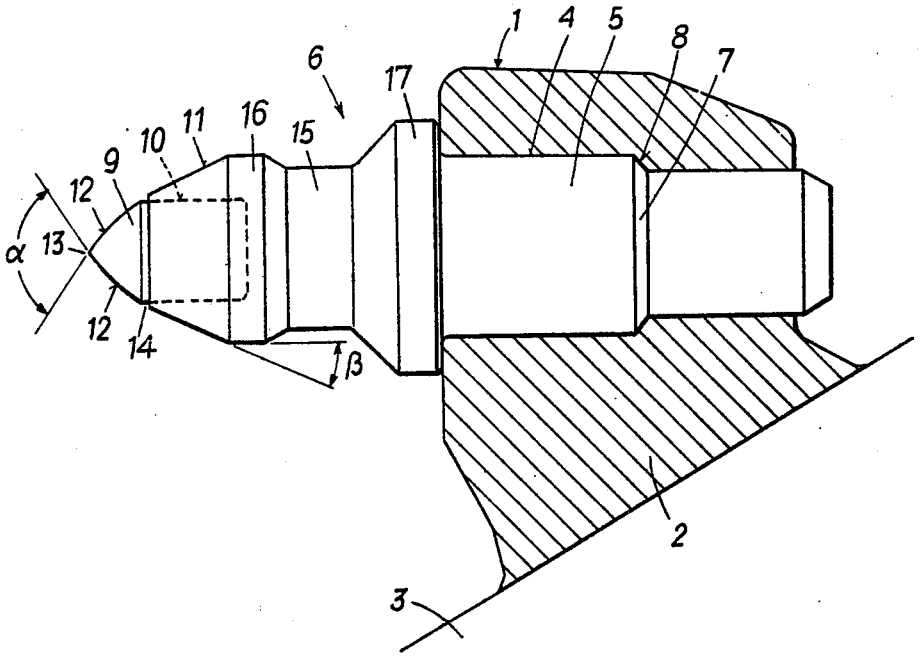
FIG. 1 shows a bit of circular cross-section in a side view and the bit holder in a section through the axis of the bit.

The foot 2 of the bit holder 1 is welded to the base member 3 of a cutting head. The bit holder 1 has an accommodating bore 4 within which the shaft portion 5 of the bit shaft 6 is rotatably supported. The shaft portion 5 has a shoulder 7 by means of which the shaft 6 is supported in axial direction against a step 8 provided within the bore 4. By means of a lock not shown, the bit is protected from falling out of the accommodating bore 4. 9 is a bit tip consisting of carbide metal and being inserted into the bore 10 of the bit shaft 6. At the area 11, the bit shaft 6 is tapered in direction to the inserted bit tip 9 according to a truncated cone. 17 is a collar of the bit shaft 6 for covering the accommodating bore 4 of the bit holder 1.

The bit tip 9 has not, as in known embodiments, a conical shape but has convex generatrices 12 which include at the tip 13 of the bit tip 12 an angle $\alpha$ of approximately 110°. The tip angle, which is included by the generatrices 12 at the transition area 14 to the truncated conical portion 11 of the bit shaft 6, is approximately equal to the tip angle $2\beta$ of the truncated conical portion 11 so that the bit tip 9 is smoothly passing into the portion 11 having the shape of a truncated cone.

Between the portion 11 having the shape of a truncated cone and the bit holder 1, the bit shaft 6 is reduced to a smaller diameter at the area 15. Adjacent the portion 11 having the shape of a truncated cone a cylindrical portion 16 is provided whose diameter is equal to the greatest diameter of the portion 11 having the shape of a truncated cone. The portion 15, having a smaller diameter than is the greatest diameter of the portion 11 having the shape of a truncated cone, is thus extending from the cylindrical portion 16 up to the collar 17, noting that the cylindrical portion 16 as well as the collar 17 are passing over conical surfaces into said portion 15 of smaller diameter.

In view of the bit shaft 6 being rotatable within the bit holder, the bit shaft on operation is continuously rotated for small angles, so that a self-sharpening action for the bit tip 9 is provided and non-uniform wear of the tip and the whole bit can be avoided.

Figure 2:
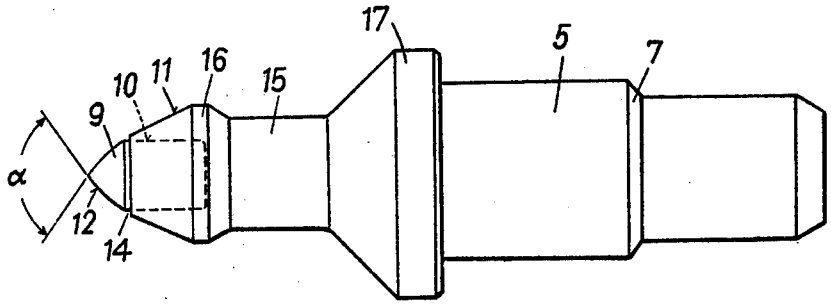
FIG. 2 shows a modification of the bit of circular cross-section in a side view.

The embodiment shown in FIG. 2 is differing from that shown in FIG. 1 only in that the bit has a more slender shape and that the portion of reduced diameter 15 is, with respect to its diameter, given a greater length than in the arrangement shown in FIG. 1.

Figure 3:
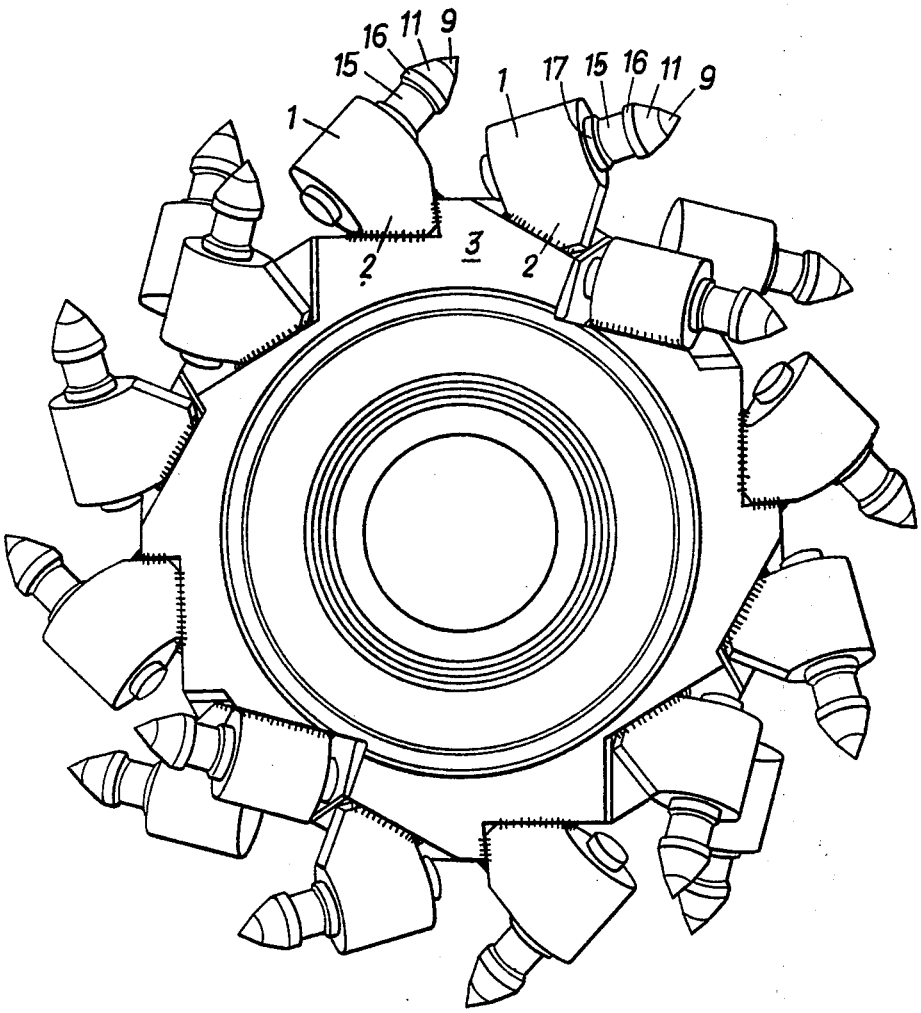
FIG. 3 shows an arrangement of the bits within the bit holders fixed in a cutting head.

FIG. 3 shows the arrangement of the bit holders 1 on the base member 3 of a cutting head. The bit holders 1 are welded to the base member 3 of the cutting head with its respective foot 2. The shaft 6 of the bits is inserted into the respective accommodating bores of the bit holders 1, noting that the lock preventing the bits from falling out of the accommodating bores of the bit holders are not shown.

What we claim is:

1. A cutting bit comprising a bit shaft of circular cross-section having one end portion adapted to be inserted into a bore in a bit holder and carrying in a bore in its other end the inner end of a hard bit tip made of carbide metal, said bit tip having a tapered outer end portion which is of circular cross-section coaxial with the bit shaft and which has the shape of a body of revolution with convex generatrices, the portion of said shaft adjacent said bit tip tapering toward said bit tip and having the shape of a truncated cone with straight generatrices, the angle of the truncated conical portion being approximately equal to the angle of the outer end portion of said bit tip, and the truncated conical portion terminating adjacent the beginning of the taper of the outer end portion of said bit tip, said shaft having a collar portion adjacent said one end portion for covering the bore in the holder, and said shaft having a portion of reduced diameter located between said collar portion and the location at which the taper toward said bit tip begins.

2. A bit as in claim 1 wherein said bit shaft has a cylindrical portion between said tapered shaft portion and said reduced diameter portion.

3. A bit as in claim 1 wherein the diameter of said reduced diameter shaft portion is 20% smaller than the maximum diameter of said tapered shaft portion.

4. A bit as in claim 1 wherein the diameter of said reduced diameter shaft portion is 15% to 25% smaller than the maximum diameter of said tapered shaft portion.

5. A bit as in claim 1 wherein the shape of said outer end portion of said bit tip has the shape of a body of revolution with convex generatrices.

6. A bit as in claim 5 wherein said convex generatrices include an angle of at least 100° at the tip of the bit tip.

7. A bit as in claim 6 wherein said tip angle is 110°.

* * * * *